US011077988B1

(12) United States Patent
Betancourt

(10) Patent No.: US 11,077,988 B1
(45) Date of Patent: Aug. 3, 2021

(54) HANDLE SYSTEM FOR OBLONG CARRYING CASES

(71) Applicant: Rolando Betancourt, Miami, FL (US)

(72) Inventor: Rolando Betancourt, Miami, FL (US)

( * ) Notice: Subject to any disclaimer, the term of this patent is extended or adjusted under 35 U.S.C. 154(b) by 0 days.

(21) Appl. No.: 16/444,731

(22) Filed: Jun. 18, 2019

(51) Int. Cl.
*B65D 25/28* (2006.01)
*A45C 13/26* (2006.01)
*G10G 7/00* (2006.01)

(52) U.S. Cl.
CPC ..... *B65D 25/2844* (2013.01); *A45C 13/26* (2013.01); *G10G 7/005* (2013.01)

(58) Field of Classification Search
CPC ..... A45C 13/26; B65D 25/2844; G10G 7/005
See application file for complete search history.

(56) References Cited

U.S. PATENT DOCUMENTS 1,709,593 A * 4/1929 Romanoff ..... A45C 13/28 190/115
2,181,208 A * 11/1939 Satz ..... A45C 13/26 190/115
2,437,099 A * 3/1948 Krupp ..... A45C 13/10 150/107
2,769,474 A * 11/1956 Klotz ..... A45C 13/22 190/115
3,168,173 A * 2/1965 Koffler ..... A45C 13/26 16/405
3,833,751 A * 9/1974 Chapman ..... G10D 1/085 84/726
9,744,425 B2 * 8/2017 Klevana ..... A45C 5/14
9,980,548 B1 * 5/2018 Lai ..... A45C 13/26
10,019,037 B2 * 7/2018 Lee ..... G06F 1/1656
2011/0232464 A1 * 9/2011 Donnellan ..... G10D 1/00 84/726

* cited by examiner

*Primary Examiner* — Tri M Mai
(74) *Attorney, Agent, or Firm* — Ruben Alcoba, Esq.

(57) ABSTRACT

A handle system for oblong carrying cases that is composed of an oblong carrying case, a pair of diametrically opposed inwardly curved channels that are located within the recess and a handle that has two diametrically opposed legs and each leg has wheels. The curved channels allow the handle to tilt at an angle that is approximately 15 degree of rotation in relation to the channels. The oblong case can be a guitar carrying case.

4 Claims, 4 Drawing Sheets

HANDLE SYSTEM FOR OBLONG CARRYING CASES

BACKGROUND

The present invention pertains to the field of handle systems that are built into oblong carrying cases.

The inventor of the present invention, during one of his travels, checked in his guitar at an airport. The guitar was damaged, for the handle rested above the carrying case. The guitar carrying case was almost lost, for the indicia that identified the owner was on the handle. The incident caused the inventor of the present invention to conceive an oblong carrying case that had a recessed handle.

The inventor when designing the present invention realized that there was a need to design an oblong carrying case that had an ergonomic handle that would tilt within a channel that holds the handle to provide the least amount of stress on the wrist of the person carrying the carrying case.

The present invention is a handle system for oblong carrying cases that minimizes the damage that can occur to the handle and that is ergonomic.

SUMMARY

The present invention is a handle system for oblong carrying cases. The handle system comprises of an oblong carrying case. A pair of diametrically opposed inwardly curved channels that are located within the recess. And, a handle that has two diametrically opposed legs and each leg has wheels. The curved channels allow the handle to tilt at an angle that is approximately 15 degree of rotation in relation to the channels. In a preferred embodiment the oblong case is a guitar carrying case.

An object of the present invention is to provide an oblong carrying case that has a handle system that is difficult to damage.

Another object of the present invention is to provide an oblong carrying case that has an ergonomic handle system.

DRAWINGS

These and other features, aspects, and advantages of the present invention will become better understood with regards to the following description, appended claims, and drawings where:

DESCRIPTION

Figure 1:
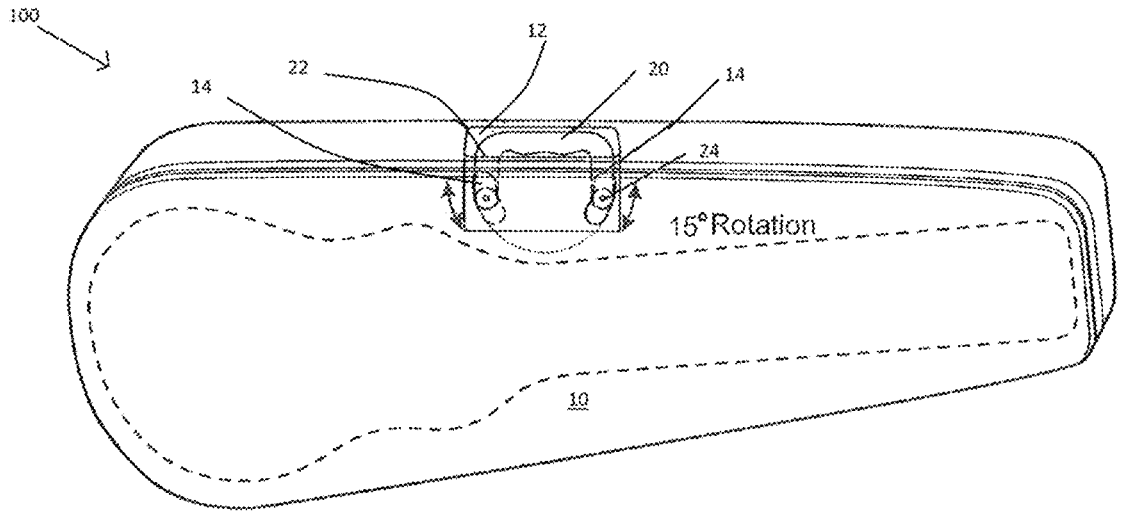
FIG. 1 is a side view of the present invention.
Figure 2:
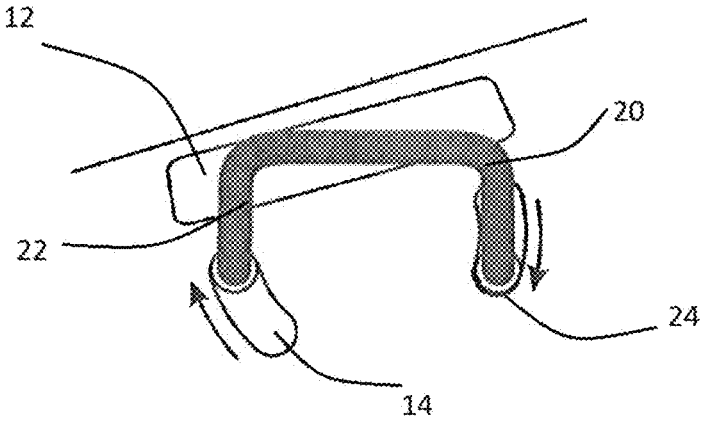
FIG. 2 is a side view that shows the recess the channels and the handle of the present invention at a 15 percent rotation.
Figure 3:
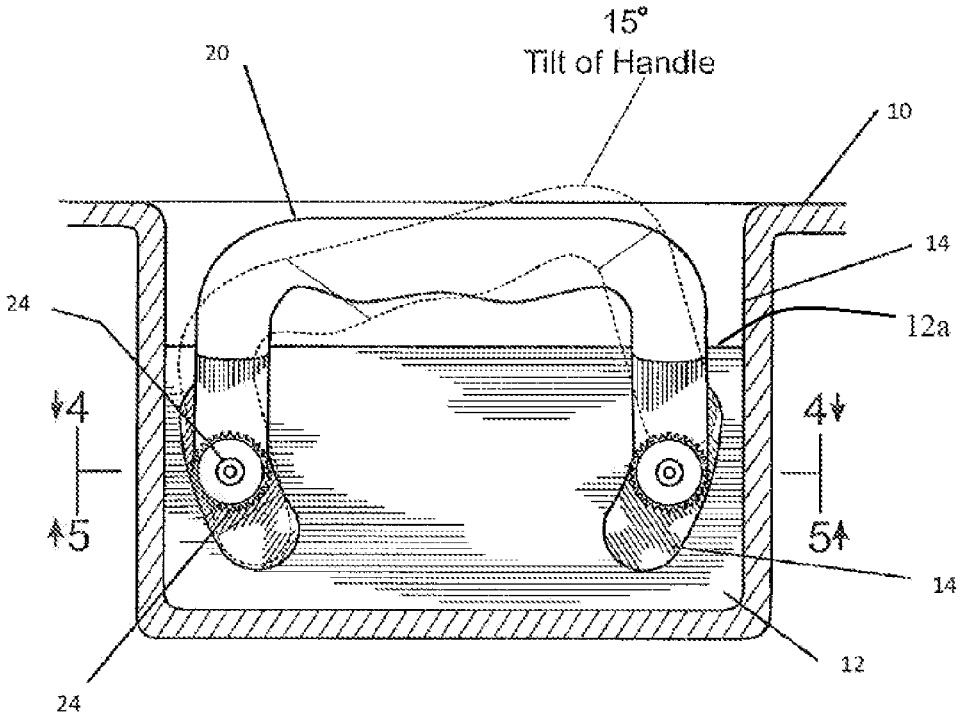
FIG. 3 is a side view that shows the handle within the recess and the channels.
Figure 4:
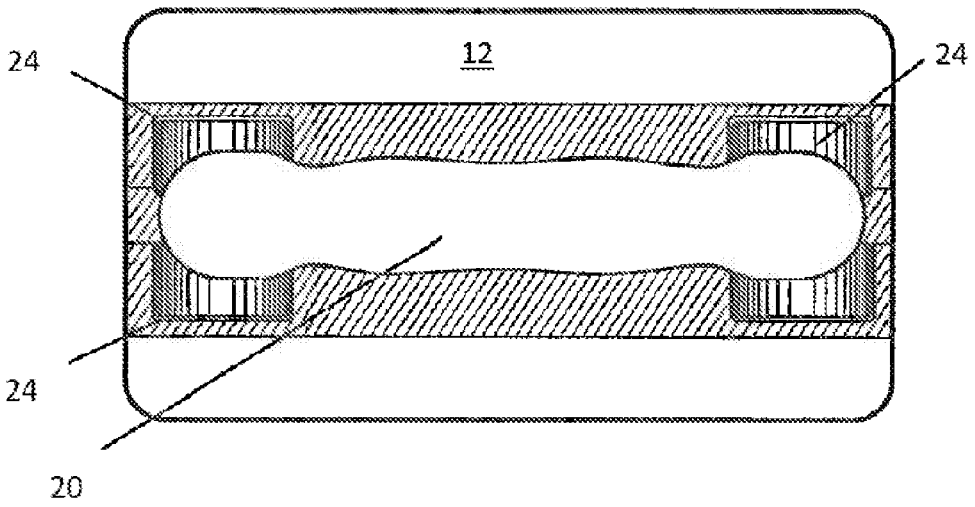
FIG. 4 is a top view of the handle within the recess and the channels.
Figure 5:
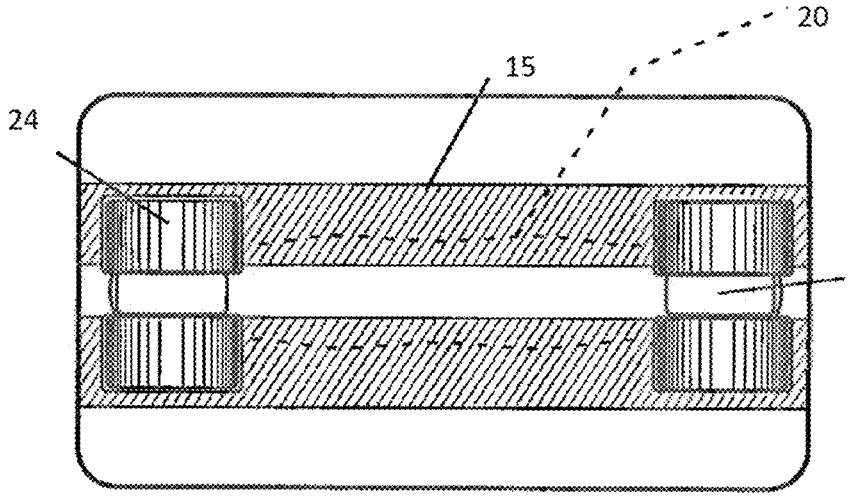
FIG. 5 is a bottom view of the handle within the channels.
Figure 6:
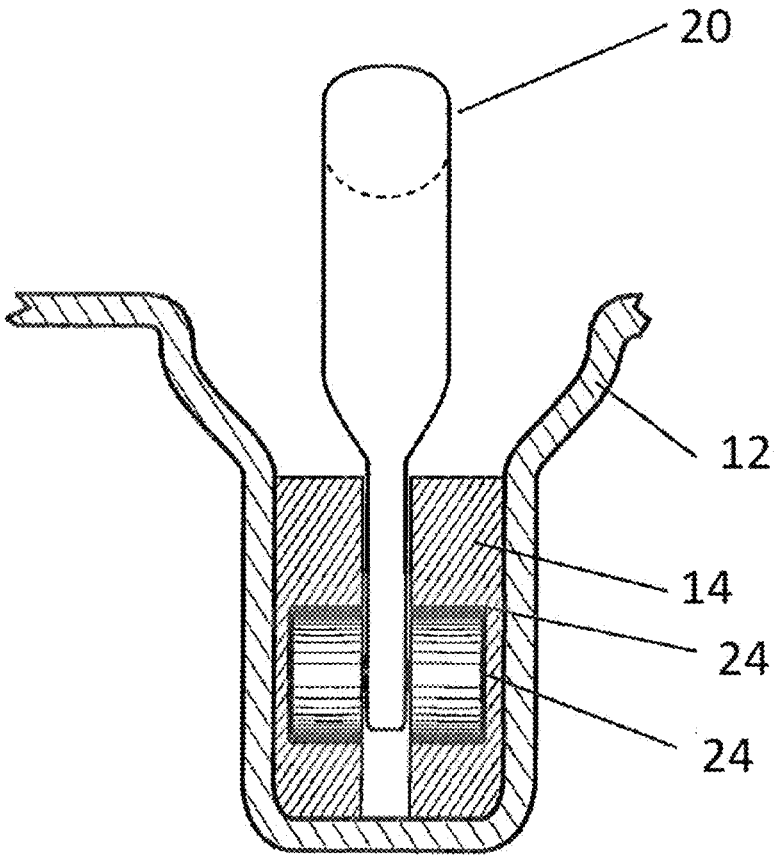
FIG. 6 is an end view of the recess that shows the wheel of the handle within the recess.

Referring to FIGS. 1-6, the present invention is a handle system 100 for oblong carrying cases. The system comprises 100 an oblong carrying case 10 that defines a rectangular recess 12 that has a flat plane bottom 12*a*. A pair of curved channels 14 that slant inward from the flat plane bottom 12*a* of the rectangular recess that are located at two diametrically opposed points within the rectangular recess 12. And, a handle 20 that has two diametrically opposed legs 22 and each leg 22 has wheels 24, wherein the curved channels 14 allow the handle 20 to tilt at an angle that is approximately 15 degree of rotation in relation to the flat plane bottom 12*a* of the rectangular recess 12.

In a preferred embodiment, the wheels 24 are rubber wheels 24.

In an embodiment, the curved channels 14, shall define channel plates 15.

In a preferred embodiment the oblong carrying case 10 is a guitar carrying case 10.

An advantage of the present invention is that it provides an oblong carrying case that has a handle system that is difficult to damage.

Another advantage of the present invention is that it provides an oblong carrying case that has an ergonomic handle system.

The embodiments of the apparatus and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus and method should be construed as limiting the invention to a particular embodiment or combination of embodiments. The scope of the invention is defined by the appended claims.

What is claimed is:

1. A handle system for oblong carrying cases, the system comprises: an oblong carrying case that defines a rectangular recess that has a flat plane bottom;

a pair of curved channels that slant inward from the flat plane bottom of the rectangular recess that are located at two diametrically opposed points within the rectangular recess; and a handle that has two diametrically opposed legs and each leg has wheels, wherein the curved channels allow the handle to tilt at an angle that is approximately 15 degree of rotation in relation to the flat plane bottom of the rectangular recess.

2. The handle system for oblong carrying cases of claim 1, wherein the wheels are rubber wheels.

3. The handle system for oblong carrying cases of claim 2, wherein the curved channels define channel plates.

4. The handle system for oblong carrying cases of claim 3, wherein the oblong carrying case is a guitar carrying case.

* * * * *